United States Patent [19]

Jarrett et al.

[11] 4,375,945

[45] Mar. 8, 1983

[54] FUEL INJECTION PUMPING APPARATUS

[75] Inventors: Boaz A. Jarrett, London; Dorian F. Mowbray, Burnham, both of England

[73] Assignee: Kucas Industries Limited, Birmingham, England

[21] Appl. No.: 222,886

[22] Filed: Jan. 6, 1981

[30] Foreign Application Priority Data

Jan. 31, 1980 [GB] United Kingdom ..... 8003263

[51] Int. Cl.[3] ..... F04B 19/02

[52] U.S. Cl. ..... 417/462; 417/488

[58] Field of Search ..... 417/462, 488

[56] References Cited

U.S. PATENT DOCUMENTS 2,765,741 10/1956 Hogeman ..... 417/462

3,712,761 1/1973 Mowbray ..... 417/462

*Primary Examiner*—Alan Cohan

[57] ABSTRACT

A fuel injection pumping apparatus comprises a rotary distributor member having a bore containing a plunger which is moved inwardly to cause delivery of fuel by the apparatus by cam lobes formed on the internal surface of a cam ring. The cam lobes are regularly spaced but in order to balance the forces acting on the distributor member the bore houses a further plunger which is held against outward movement by means of a roller which engages the internal surface of a pair of stop rings mounted in the housing of the apparatus.

4 Claims, 2 Drawing Figures

FUEL INJECTION PUMPING APPARATUS

This invention relates to liquid fuel injection pumping apparatus for supplying fuel to an internal combustion engine and of the kind comprising a rotary distributor member housed within a body, a transversely disposed bore formed in the distributor member, a plunger positioned in the bore, an annular cam ring surrounding the distributor member and having inwardly directed cam lobes for imparting inward movement to the pumping plunger and means for conveying fuel to and from said bore.

Such pumps are well known in the art and in order to prevent unbalance of the forces acting on the distributor member, it is the practice to provide a further plunger or plungers in a bore continuous with said bore or in further bores which are positioned so that in operation when the plunger is moved inwardly, the forces acting on the distributor member are balanced. The further plunger or plungers engages the cam ring and it is the usual practice to arrange that they are also moved inwardly so that their inward movement contributes to the supply of fuel by the apparatus. For engines with an even number of cylinders it is easy to position the cam lobes so that delivery of fuel takes place at the desired intervals. There are engines however which have an odd number of cylinders or "V" engines which have an awkward angle between the banks of cylinders and for which it is less easy to position the cam lobes so that delivery can take place at the desired intervals.

The object of the present invention is to provide an apparatus of the kind specified in a simple and convenient form.

According to the invention in an apparatus of the kind specified a further plunger is provided in said bore and means is provided which surrounds the distributor member but is separate therefrom, and which acts to retain said further plunger against outward movement in the bore.

Examples of apparatus in accordance with the invention will be described with reference to the accompanying drawings, the two figures showing sectional side elevations of two examples.

Figure 1:
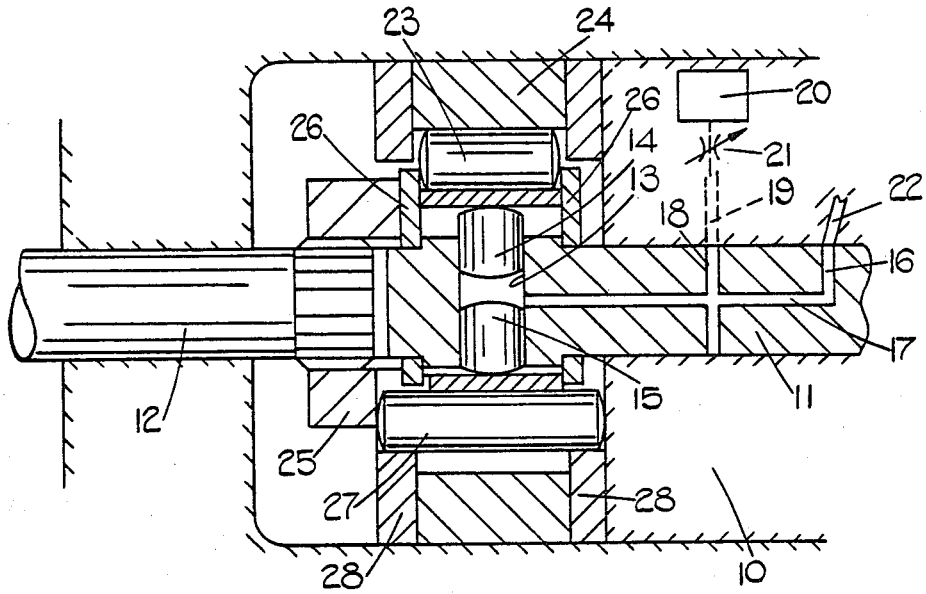
FIG. 1 shows a first embodiment of the invention.

Referring to FIG. 1 of the drawings there is provided a housing 10 in which is journalled a rotary cylindrical distributor member 11 which is arranged to be driven by a drive shaft 12 coupled in use to a rotary part of the engine to which fuel is supplied, so that the distributor member rotates in synchronism with the engine. The distributor member is provided with a transversely extending bore 13 in which is located an active plunger 14 and an inactive or balancing plunger 15. The bore 13 communicates with a delivery passage 16 by way of a longitudinal passage 17 and the passage 17 communicates with a plurality of inlet passages 18. The passages 18 are arranged to register in turn with an inlet port 19 the latter being connected to a source of fuel under pressure generally indicated at 20 by way of a fuel control device indicated as being a variable restriction 21.

The passage 16 can register in turn with a plurality of outlet ports 22 which in use, are connected to the injection nozzles of the associated engine respectively.

Associated with the plunger 14 is a roller 23 which is carried by a shoe which engages the plunger 14. The roller 23 can contact the internal peripheral surface of an annular cam ring 24 there being formed on said surface a plurality of inwardly directed cam lobes equal in number to the number of cylinders of the associated engine. Conveniently the roller and its associated shoe are located within a slot formed in an annular part 25 which surrounds the distributor member and is in driving engagement with the drive shaft 12. Annular side plates 26 are provided to retain the shoe and plunger 23 against axial movement.

The plunger 15 is held against outward movement and for this purpose there is provided a further roller 27 also mounted in a shoe which engages the plunger 15, the roller 27 is longer than the roller 23 and is arranged to engage the internal peripheral surface of a pair of annular stop members 28 which are disposed on opposite sides of the cam ring 24. The internal surfaces of the stop members 28 are of cylindrical form whereby no movement will be imparted to the plunger 15 as the distributor member rotates.

The operation of the apparatus is well known, it being arranged that a passage 18 is brought into register with the inlet port 19 when the plunger 14 is allowed to move outwardly. The amount of fuel supplied to the bore during such outward movement is determined by the setting of the control device and upon further rotation of the distributor member, the passage 18 moves out of register with the port 19 and the delivery passage 17 moves to register with an outlet 22. During this period of communication inward movement of the plunger 14 takes place and fuel is delivered to the respective injection nozzle of the engine. The pressure of fuel in the bore 13 acts upon the plunger 15 and the axial thrust generated thereby is taken by the roller 27 and the stop members 28. Thus substantially no side thrust is imparted to the distributor member. The lobes on the cam and the disposition of the passages 18 and ports 22 can be chosen to suit the associated engine. It is thus possible to supply fuel to an engine which has an odd number of cylinders or in which the firing intervals are unequal.

Figure 2:
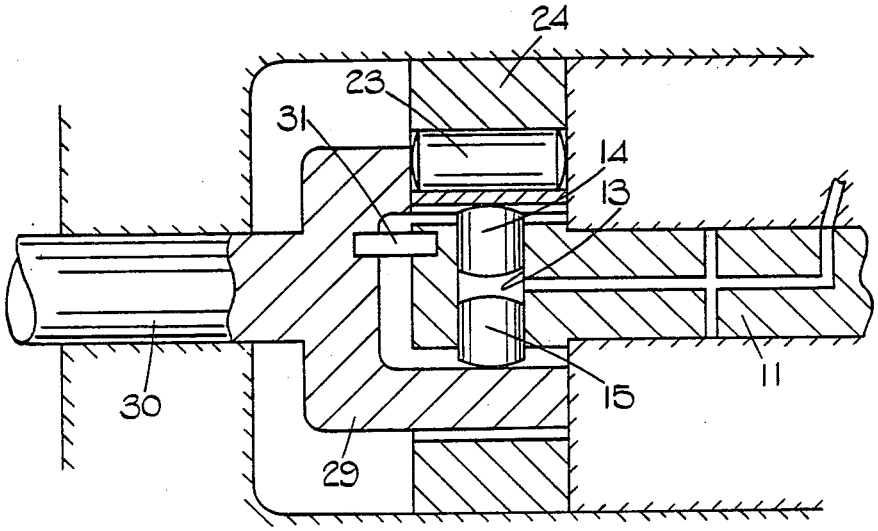
FIG. 2 shows another embodiment of the invention.

In the arrangement which is seen in FIG. 2, the distributor member is surrounded by a cup-shaped portion 29 which is integral with the drive shaft 30. The cup-shaped portion has a single axial slot which accommodates a roller 23 and the associated shoe so that the shoe and roller can move radially during rotation of the distributor member, the latter being driven by an off-set peg 31. The outer end of the plunger 15 engages the internal peripheral surface of the cup-shaped part 29, the roller being omitted because there is no relative angular movement between the plunger 15 and the part 29. The part 29 does however absorb the thrust developed on the plunger 15 by the action of fluid pressure within the bore 13. In this example, the drive shaft 30 and its bearings, must be sufficiently robust to withstand the side thrust imposed by the plunger 15 and the thickness of the wall of the cup-shaped portion must be chosen so that it does not foul the crests of the cam lobes formed on the internal peripheral surface of the cam ring.

We claim:

1. A liquid fuel injection pumping apparatus for supplying fuel to an internal combustion engine and of the kind comprising a rotary distributor member housed within a body, a transversely disposed bore formed in the distributor member, a plunger positioned in the bore, an annular cam ring surrounding the distributor member and having inwardly directed cam lobes for imparting inward movement to the pumping plunger and means for conveying fuel to and from said bore, a further plunger in said bore, means surrounding the distributor member but separate therefrom, said means acting to retain said further plunger against outward movement in the bore.

2. An apparatus according to claim 1 in which the means surrounding the distributor member comprises a pair of annular stop members positioned on opposite sides of said annular cam ring, said stop members defining internal surfaces of cylindrical form and a further roller engaged with said cylindrical surfaces, said further roller being mounted in a shoe engaging said further plunger.

3. An apparatus according to claim 1 in which the means surrounding the distributor member comprises a cup-shaped portion rotatably mounted within a body of the apparatus, said further plunger engaging the internal surface of said cup-shaped portion, a slot formed in said cup-shaped portion and a shoe slidable therein said shoe carrying a roller engaging the internal surface of said cam ring and said first mentioned plunger being engaged by said shoe.

4. An apparatus according to claim 3 in which said cup-shaped portion is carried by a drive shaft of the apparatus means being provided to rotatably connect the drive shaft to the distributor member.

* * * * *

UNITED STATES PATENT AND TRADEMARK OFFICE

CERTIFICATE OF CORRECTION

PATENT NO. : 4,375,945

DATED : March 8, 1983

INVENTOR(S) : Boaz A. Jarrett et al

It is certified that error appears in the above-identified patent and that said Letters Patent are hereby corrected as shown below:

On the title page:

[73] Assignee: Lucas Industries Limited, Birmingham, England

Signed and Sealed this

*Twentieth* Day of *September 1983*

[SEAL]

*Attest:*

GERALD J. MOSSINGHOFF

*Attesting Officer*

*Commissioner of Patents and Trademarks*